US007481428B2

(12) United States Patent
Kato

(10) Patent No.: US 7,481,428 B2
(45) Date of Patent: Jan. 27, 2009

(54) PAPER LEAF DETECTING DEVICE

(75) Inventor: Yoshiyuki Kato, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 513 days.

(21) Appl. No.: 11/285,201

(22) Filed: Nov. 23, 2005

(65) Prior Publication Data

US 2006/0125176 A1 Jun. 15, 2006

(30) Foreign Application Priority Data

Dec. 14, 2004 (JP) ..... P2004-361140

(51) Int. Cl.
*B65H 7/02* (2006.01)

(52) U.S. Cl. ..... 271/259; 271/261; 271/265.03; 194/207; 194/318

(58) Field of Classification Search ..... 271/261, 271/259, 265.02, 265.03; 194/207, 318, 194/317
See application file for complete search history.

(56) References Cited

U.S. PATENT DOCUMENTS 5,614,824 A 3/1997 Dames et al.
6,394,256 B2 * 5/2002 Mukai ..... 194/207
6,823,995 B2 * 11/2004 Mukai ..... 209/534
6,840,365 B2 * 1/2005 Loffler ..... 194/207
2004/0155650 A1 8/2004 Plaas-Link et al.

FOREIGN PATENT DOCUMENTS

| | | |
|---|---|---|
| EP | 0 413 534 A | 2/1991 |
| EP | 0 690 421 A | 1/1996 |
| JP | 9-24686 | 1/1997 |
| TW | 00215729 | 11/1993 |
| TW | 566632 | 12/2003 |
| WO | WO 98/38792 A | 9/1998 |
| WO | WO 99/23601 A | 5/1999 |

* cited by examiner

*Primary Examiner*—David H Bollinger
(74) *Attorney, Agent, or Firm*—Nixon & Vanderhye P.C.

(57) ABSTRACT

A paper leaf detecting device includes a plurality of sensors positioned at an oblique angle relative to a transporting direction of leaves of paper, the plurality of sensors being arranged in a single row that extends in a direction orthogonal to the transporting direction of the leaves of paper. The paper leaf detecting device makes it possible to detect information on leaves of paper by using their transportation to scan the leaves of paper in a direction that is orthogonal to the transporting direction. An increase in size in the transporting direction of the leaves of paper is prevented.

13 Claims, 6 Drawing Sheets

PAPER LEAF DETECTING DEVICE

BACKGROUND OF THE INVENTION

1. Field of the Invention

Priority is claimed on Japanese Patent Application No. 2004-361140, filed Dec. 14, 2004, the contents of which are incorporated herein by reference.

The present invention relates to a paper leaf detecting device that detects leaves of paper.

2. Description of Related Art

In order to prevent counterfeiting or in order to identify a banknote type or the like, security threads are provided in various leaves of paper such as banknotes and the like. Namely, by providing a security thread having, for example, predetermined magnetic properties in leaves of paper, the genuineness and the like of the leaves of paper can be identified depending on whether or not this security thread is detected and the type of money can be identified from the magnetic properties.

Information that has been encoded using magnetic intensity or the like is provided by being arrayed in the lengthwise direction of these security threads. If information is provided in a security thread that is arrayed in the lengthwise direction of the security thread, then it is necessary for the detecting side to detect by scanning the security thread in the lengthwise direction thereof. If the security thread is aligned in the transporting direction of leaves of paper, then if a magnetic sensor is provided at a position traveled over by the security thread, it is possible using this magnetic sensor device to perform a scan using the transporting of the leaves of paper or the like. However, if the security thread is perpendicular relative to the transporting direction of the leaves of paper, then in this type of magnetic sensor device it is not possible to scan using the transporting of the leaves of paper. Because of this, a technology (see Japanese Patent Application Unexamined Publication No. 9-24686) exists that, by placing a linear magnetic sensor device obliquely relative to the transporting direction of the leaves of paper, makes it possible to scan using the transporting of the leaves of paper even when the security thread is perpendicular to the transporting direction of the leaves of paper.

However, as is described above, in an apparatus in which a linear magnetic sensor device is placed obliquely relative to the transporting direction of the leaves of paper, the space used to position the magnetic sensor device is enlarged particularly in the transporting direction of the leaves of paper. As a result, the problem arises that the size of the device becomes enlarged in this direction. This type of problem also arises unrelated to any detection of the above described security thread when information is detected by performing scanning in a direction that is perpendicular to the transporting direction of the leaves of paper at the same time as the leaves of paper are being transported.

Accordingly, it is an object of the present invention to provide a paper leaf detecting device that makes it possible to detect information by performing scanning in a direction that is perpendicular to the transporting direction of the paper leaves at the same time as the leaves of paper are being transported, and that also prevents size enlargement in the transporting direction of the leaves of paper.

SUMMARY OF THE INVENTION

In order to achieve the aforementioned object, according to the present invention, there is provided a paper leaf detecting device comprising a plurality of sensors positioned at an oblique angle relative to a transporting direction of leaves of paper, the plurality of sensors being arranged in a single row that extends in a direction orthogonal to the transporting direction of the leaves of paper.

With the thus constructed paper leaf detecting device, by positioning sensors at an oblique angle relative to the transporting direction of leaves of paper, it is possible to detect information by using this transporting to scan the leaves of paper in a direction that is orthogonal to the transporting direction. At this time, by providing a plurality of sensors and arranging these sensors in a row extending in a direction that is orthogonal to the transporting direction of the leaves of paper, it is possible to prevent there being an increase in size in the transporting direction. Accordingly, it is possible to detect information by using this transporting to scan the leaves of paper in a direction that is orthogonal to the transporting direction, which makes it possible to prevent there being an increase in size in the transporting direction of the leaves of paper.

Preferably, in the paper leaf detecting device as mentioned above, directions of inclination of the plurality of sensors are all identical, and adjacent sensors are continuous with each other when seen from the transporting direction of the leaves of paper.

With the thus constructed paper leaf detecting device, because adjacent sensors are continuous with each other when seen from the transporting direction of the leaves of paper, even if a plurality of sensors are used there are no unreadable portions between the sensors and data can be read as continuous data. Moreover, because the directions of inclination of the plurality of sensors are all the same, even when the plurality of sensors are positioned in a line that extends in a direction that is orthogonal to the transporting direction of the leavers of paper, it is possible to arrange the sensors such that they are continuous when seen from the transporting direction of the leaves of paper while also preventing interference between the sensors.

Preferably, the paper leaf detecting device as mentioned above further comprises a plurality of memory devices that respectively memorize output signals from each of the sensors, a synthesizing device that synthesizes signals from the memory devices as a continuous signal, and an identification device that identifies whether or not leaves of paper are authentic based on the signal synthesized by the synthesizing device.

With the thus constructed paper leaf detecting device, the plurality of memory devices respectively memorize the output signals from each sensor, and the synthesizing device synthesizes the signals from these memory devices as a continuous signal. The identification device then identifies the authenticity and type of the leaves of paper based on this synthesized signal. Accordingly, it is possible to prepare continuous data that is obtained by scanning the leaves of paper in a direction that is orthogonal to the transporting direction of the leaves of paper, and identify the authenticity of the leaves of paper based on this continuous data.

Preferably, in the paper leaf detecting device as mentioned above, adjacent sensors have end portions that are adjacent to each other when seen from the transporting direction of the leaves of paper overlapping each other.

With the thus constructed paper leaf detecting device, because end portions that are adjacent to each other when seen from the transporting direction of the leaves of paper of adjacent sensors overlap each other by a predetermined amount, even though a plurality of sensors are used there are no unreadable portions between the sensors and, by matching phases using overlapping data portions, data can be reliably detected as continuous data. Moreover, because the directions of inclination of the plurality of sensors are all the same, even when the plurality of sensors are positioned in a line that extends in a direction that is orthogonal to the transporting direction of the leaves of paper, it is possible to arrange the sensors such that end portions thereof that are adjacent when seen from the transporting direction of the leaves of paper overlap each other by a predetermined amount, while interference between the sensors is also prevented.

Preferably, the paper leaf detecting device as mentioned above further comprises a plurality of memory devices that respectively memorize output signals from each of the sensors, a synthesizing device that synthesizes signals from the memory devices as a continuous signal using one or a portion of both of overlapping data portions from adjacent sensors, and an identification device that identifies whether or not leaves of paper are authentic based on the signal synthesized by the synthesizing device.

With the thus constructed paper leaf detecting device, the plurality of memory devices respectively memorize the output signals from each sensor, and the signal synthesizing device synthesizes the signals from these memory devices as a continuous signal using any one or a portion of both of the partially overlapping data. The identification device then identifies the authenticity and type of the leaves of paper based on this synthesized signal. Accordingly, it is possible to prepare continuous data that is obtained by scanning the leaves of paper in a direction that is orthogonal to the transporting direction of the leaves of paper, and identify the authenticity of the leaves of paper based on this continuous data.

Preferably, in the paper leaf detecting device as mentioned above, the identification device further identifies a degree to which overlapping data portions match each other.

With the thus constructed paper leaf detecting device, because the identification device identifies the degree to which the partially overlapping data matches, it is possible to identify the authenticity of the leaves of paper in even more detail.

Preferably, in the paper leaf detecting device as mentioned above, the plurality of sensors detect a security thread provided in a leaf of paper.

With the thus constructed paper leaf detecting device, because a plurality of sensors detect a security thread that is provided in leaves of paper, information in the security thread can be detected without there being an increase in size in the transporting direction of the leaves of paper.

Preferably, in the paper leaf detecting device as mentioned above, the plurality of sensors detect magnetic ink provided in a leaf of paper.

With the thus constructed paper leaf detecting device, because a plurality of sensors detect magnetic ink on leaves of paper, magnetic ink distribution information and the like can be detected without there being an increase in size in the transporting direction of the leaves of paper.

DETAILED DESCRIPTION OF THE INVENTION

The paper leaf detecting device of the first embodiment of the present invention will now be described with reference made to FIGS. 1 to 4.

Figure 1:
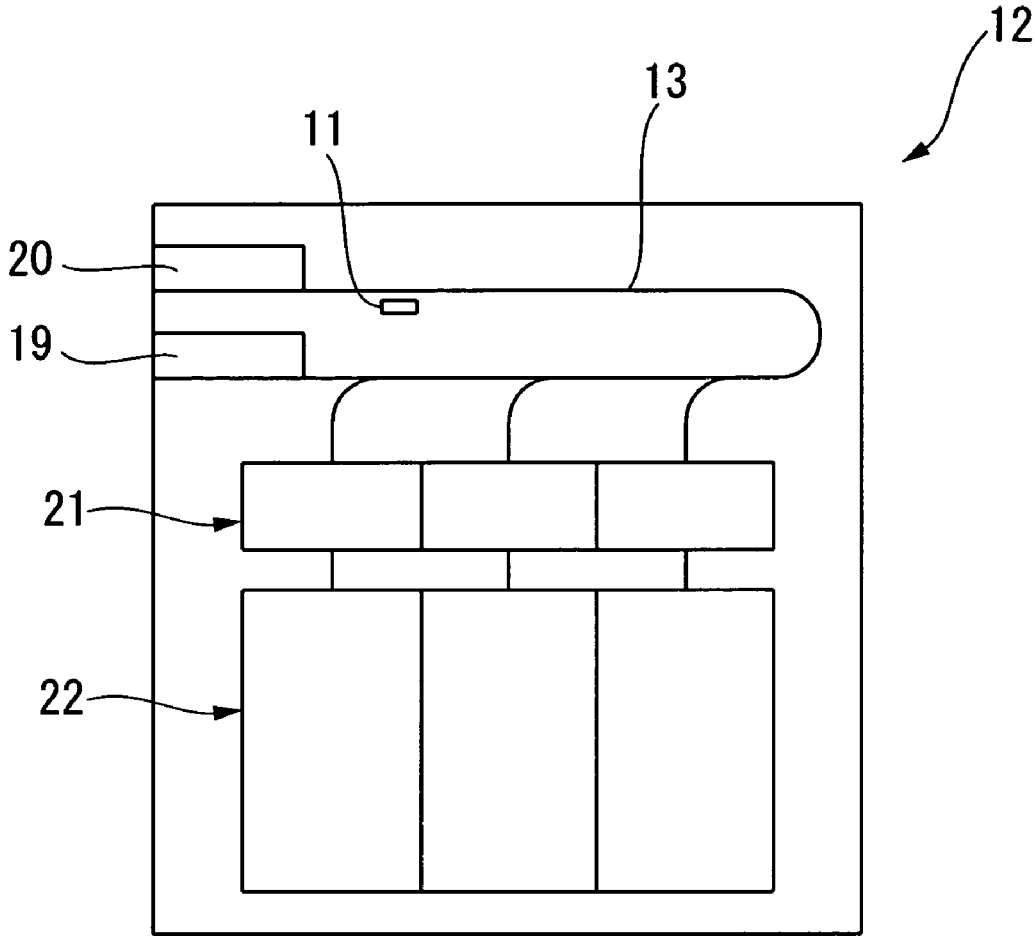
FIG. 1 is a side view schematically showing a banknote handling machine in which the paper leaf detecting device of the first embodiment of the present invention has been applied.

As is shown in FIG. 1, a paper leaf detecting device 11 of the first embodiment is incorporated in a banknote handling machine 12 that handles leaves of paper in the form of banknotes. This paper leaf detecting device 11 detects bank notes that are transported by a transporting section 13 of the banknote handling machine 12. Specifically, the paper leaf detecting device 11 of the first embodiment detects security threads 16 that are provided in banknotes 15, as is shown in FIG. 2.

As is shown in FIG. 1, in the banknote handling machine 12 in which the paper leaf detecting device 11 of the first embodiment is provided, for example, banknotes that are inserted into an insertion aperture 20 are separated into individual notes, and are transported by the transporting section 13 with the transporting direction being the lengthwise direction of each banknote. During this transportation, the authenticity and type of the banknotes are identified by the paper leaf detecting device 11 and the banknotes are counted. Any counterfeit banknotes are returned to a return aperture 19, while authentic banknotes are classified according to the type of banknote in a temporary holding section 21 and are temporarily held. Thereafter, the banknotes are stored in a storage section 22 while being classified according to banknote type.

Figure 2:
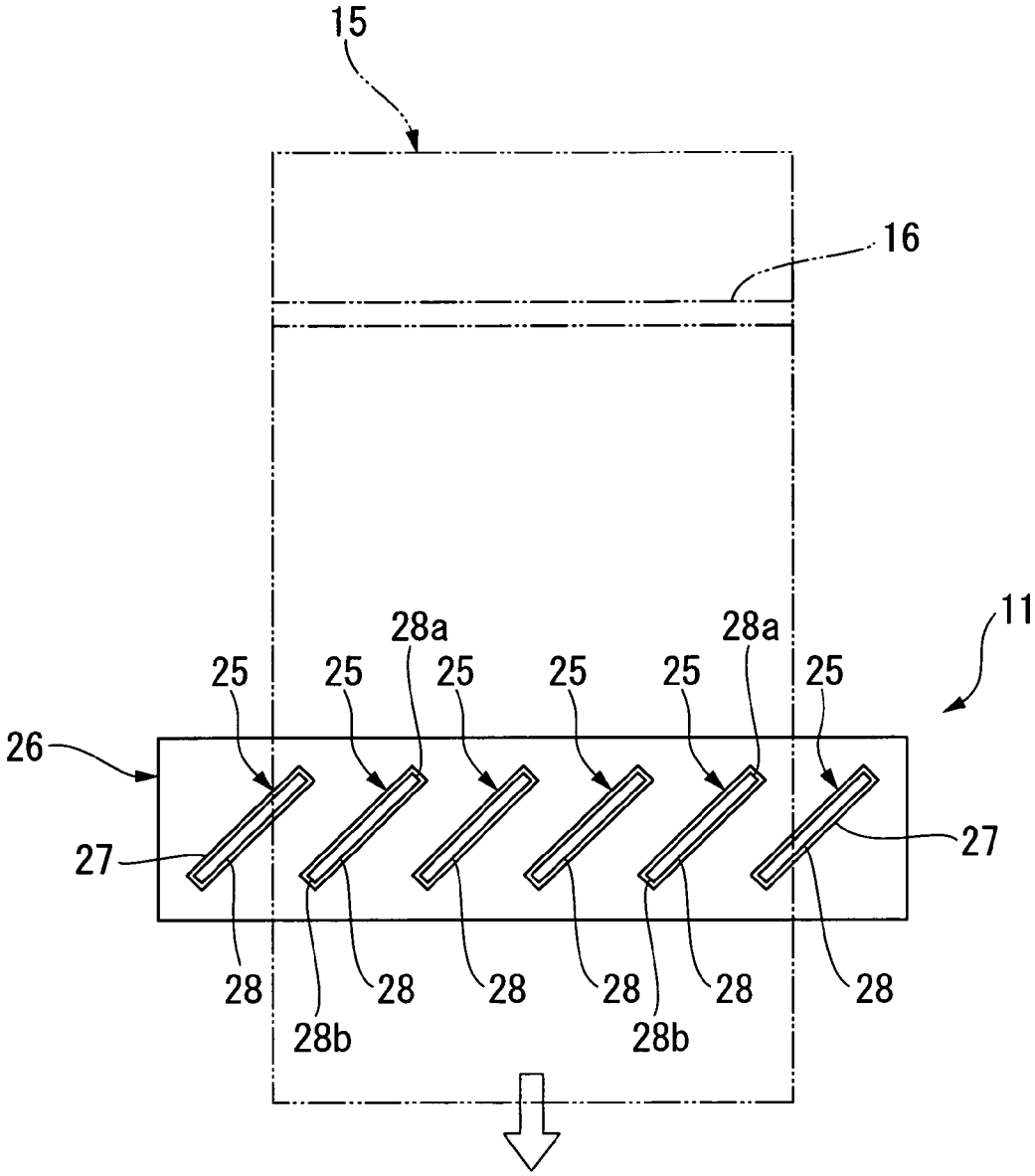
FIG. 2 is a plan view showing a banknote as well as a sensor array of the paper leaf detecting device of the first embodiment of the present invention.

As is shown in FIG. 2, the aforementioned security threads 16 are formed in the banknotes 15 so as to extend in a direction orthogonal to the lengthwise direction of the banknotes, namely, in a vertical direction thereof. Because, as is described above, the banknotes 15 are transported in the lengthwise direction thereof, the security threads may be said to be formed in the bank notes 15 in a direction that is orthogonal to the transporting direction of the banknotes 15. These security threads 16 are metal threads, and information that is encoded using magnetic intensity is held therein extending in the direction in which the security threads 16 extend. Here, the information held in the security threads 16, specifically, is monetary information that differs in accordance with the type of money of the banknotes 15. Note that the same information is repeated a plurality of times in the security thread 16 of a single banknote 15 in the direction in which the security threads 16 extend.

Figure 3:
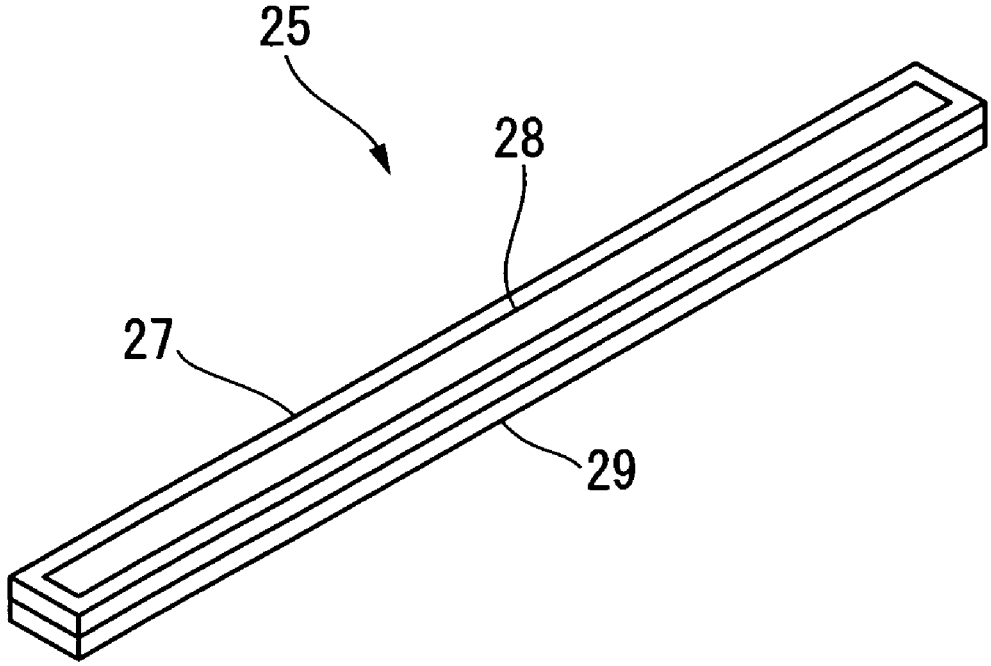
FIG. 3 is a perspective view showing a magnetic sensor of the paper leaf detecting device of the first embodiment of the present invention.

As is shown in FIG. 1, the paper leaf detecting device 11 of the first embodiment is provided in a portion of the transporting section 13 of the banknote handling machine 12 that linearly transports the banknotes 15 and detects the banknotes 15 as they move linearly from one side in the front-rear direction thereof. As is shown in FIG. 2, the paper leaf detecting device 11 is provided with a sensor array 26 that has a plurality of magnetic sensors 25 each having the same structure. As is shown in FIG. 3, in each magnetic sensor 25, rectangular detection coils (i.e., sensors) 28 are provided such that the lengthwise direction of each one is the same on top of an elongated, rectangular substrate 27 and have a width that is narrower than the substrate 27. Excitation magnets 29 are provided on the substrate 27 on the opposite side from the detection coils 28

The sensor array 26 is positioned so as to face either one of the front surface or rear surface of the banknotes 15 that are being transported by the transporting section 13. As is shown in FIG. 2, in each sensor array 26, a plurality (6 in the example in the drawing) of the above described magnetic sensors 25 are aligned in a direction that is perpendicular to the transporting direction of the banknotes. At this time, all of the magnetic sensors 25 are positioned such that the respective detection coils 28 thereof face either one of the front surface or rear surface of the banknotes 15 that are being transported by the transporting section 13. Moreover, all of the magnetic sensors 25 are lined up at the same pitch in a direction perpendicular to the banknote transporting direction with the height positions of the detection coils 28 matching and with their positions in the banknote transporting direction also matching.

Moreover, for all of the magnetic sensors 25, the rectangular detection coils 28 are positioned such that the lengthwise direction thereof is inclined at a predetermined angle (for example, 45 degrees) relative to the banknote transporting direction. As a result, the plurality of detection coils 28 that are positioned diagonally relative to the transporting direction of the banknotes 15 are arranged in a single row that is orthogonal to the transporting direction of the banknotes 15.

Here, the angle of inclination and the direction of inclination relative to the banknote transporting direction are the same in all of the detection coils 28. In addition, the positions of ends that are closest to each other of all of the adjacent detection coils 28 all match when seen from the banknote transporting direction. In other words, when seen from the transporting direction of the banknotes 15, all adjacent detection coils 28 are continuous with each other. Note that the detection coils 28 on the two outermost sides are placed so as to protrude outwards on both sides beyond the banknotes 15 being transported.

Figure 4:
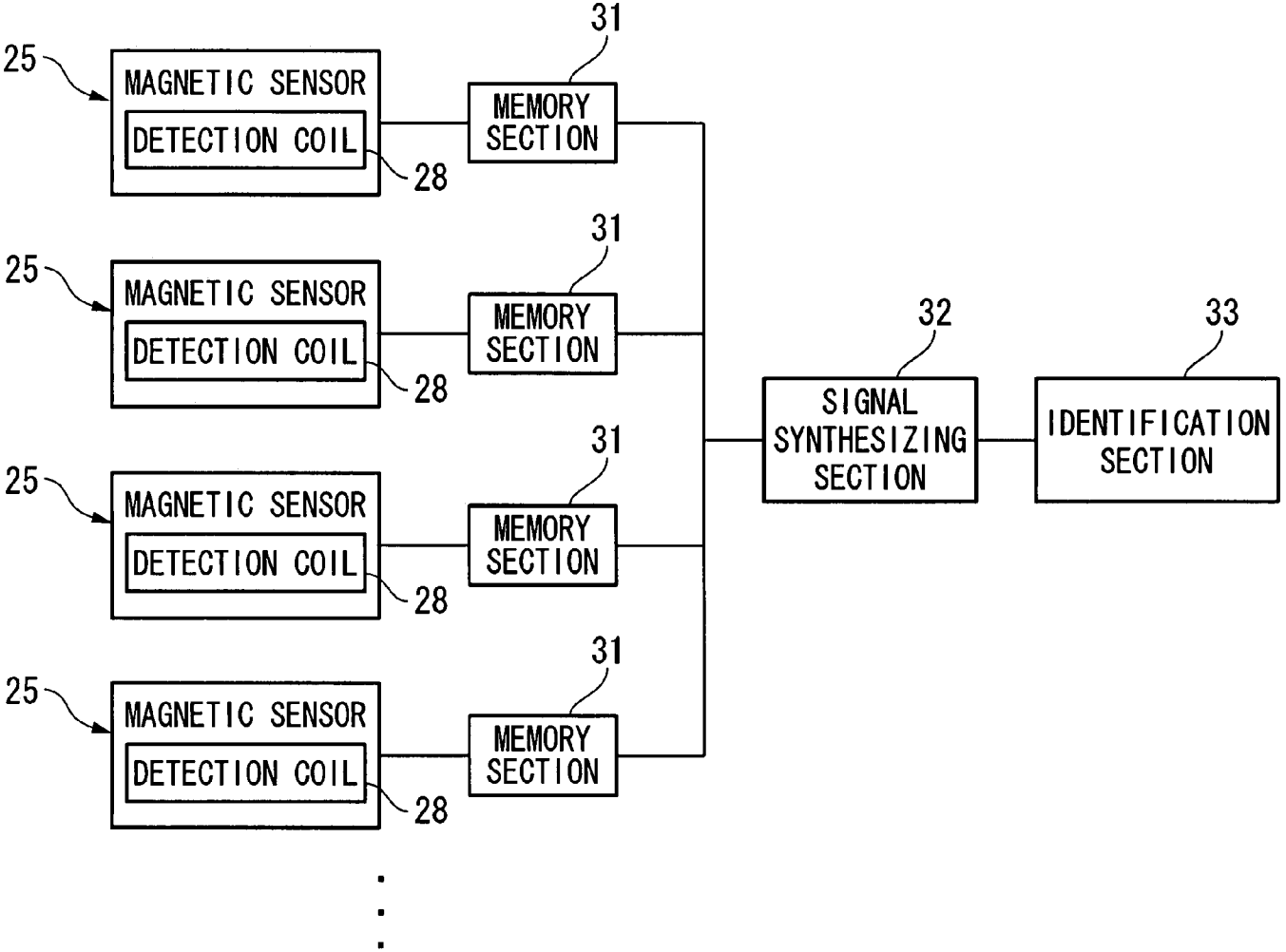
FIG. 4 is a block diagram showing the overall structure of the paper leaf detecting device of the first embodiment of the present invention.

In addition, as is shown in FIG. 4, the detection coils 28 of all of the magnetic sensors 25 in the sensor array 26 are each connected to individual memory sections (i.e., memory devices) 31. The plurality of memory sections 31 respectively memorize output signals from the corresponding detection coil 28.

All of the memory sections 31 are connected to a signal synthesizing section (i.e., a synthesizing device) 32. The signal synthesizing device 32 synthesizes the signals from each memory section 31 into a single continuous signal based on the speed at which the banknotes 15 are transported by the transporting section 13, the angle of inclination of each detection coil 28, and the length of the detection section detected by each detection coil 28.

Specifically, when a particular banknote 15 is being transported by the transporting section 13 and passes the sensor array 26, the security thread 16 is divided by the plurality of detection coils 28 into a plurality of detection sections in the direction in which the security thread 16 extends and is detected. At this time, each detection coil 28 scans a detection section of the security thread 16 in the direction in which it extends as a result of their respective inclinations.

Namely, each detection section of the security thread 16 moves, in accordance with the transporting of the banknotes 15, from an upstream portion 28*a* side, which is upstream in the transporting direction of the corresponding detection coil 28, towards a downstream portion 28*b* side. At this time, because the detection coils 28 are diagonally inclined, the intersecting portions that intersect with the detection coils 28 move from one side in the direction in which the security thread 16 extends (i.e., the upstream portion 28*a* side—the right side in FIG. 2) to the opposite side in this extension direction (i.e., the downstream portion 28*b* side—the left side in FIG. 2). In this manner, each detection section of the security thread 16 is scanned in the extension direction thereof by each detection coil 28.

Next, the signals are sequentially connected in the extension direction of the security thread 16 from a signal from the detection coil 28 that is placed at an end portion on the side where the upstream portions 28*a* are located (i.e., the right side in FIG. 2) relative to the downstream portion 28*b* in a single detection coil 28, to a signal from the detection coil 28 that is placed at an end portion on the opposite side (i.e., the left side in FIG. 2) out of all the detection coils 28, while the time differential and phase are shifted based on the speed at which the banknotes 15 are transported by the transporting section 13, the angle of inclination of each detection coil 28, the length of the detection section detected by each detection coil 28, and the order of the detection coils 28. As a result, a signal is obtained that is the same as a signal that is scanned continuously in the extension direction of the security thread 16. This signal has a signal waveform in a pattern that corresponds to the encoded magnetic information held in the security thread 16.

In this manner, a signal that has been synthesized by the signal synthesizing section 32 as a single continuous signal is input into an identification section (i.e., an identification device) 33. In the identification section 33, based on this input signal, the authenticity and type of the banknote 15 is identified from the code that is read from the security thread 16 and the result thereof is output to a control section (not shown) on the banknote handling machine 12 side. In this control section, if the banknote detected by the sensor array 26 is a counterfeit banknote, it is returned to the return aperture 19. If the banknote detected by the sensor array 26 is an authentic banknote, counting and the like is conducted based on the type of the banknote and the banknote is temporarily held in the temporary holding section 21. Subsequently, the banknote is stored in the storage section 22.

According to the above described paper leaf detecting device 11 of the first embodiment, by positioning the detection coils 28 obliquely relative to the transporting direction of the banknotes 15, it is possible by making use of the transporting of the banknotes 15 to detect information in the security threads 16 by scanning the banknotes 15 in a direction orthogonal to the transporting direction. At this time, by providing a plurality of detection coils 28 and arranging this plurality of detection coils 28 in a line in a direction that is orthogonal to the transporting direction of the banknotes 15, it is possible to prevent increase in size in the transporting direction. Accordingly, it is possible by making use of the transporting of the banknotes 15 to detect information by scanning the banknotes 15 in a direction orthogonal to the transporting direction, and it is thereby possible to prevent an increase in size in the transporting direction of the banknotes 15.

Moreover, because adjacent detection coils 28 are continuous with each other when seen from the transporting direction of the banknotes 15, even though a plurality of detection coils 28 are used there are no unreadable portions between the detection coils 28 and data can be read as continuous data. Specifically, the plurality of memory sections 31 respectively memorize the output signals from each detection coil 28, and the signal synthesizing section 32 synthesizes the signals from these memory sections 31 as a continuous signal. The identification section 33 then identifies the authenticity and type of the banknote 15 based on this synthesized signal. Accordingly, it is possible to prepare continuous data that is obtained by scanning the security threads 16 in a direction that is orthogonal to the transporting direction of the banknotes 15, and identify the authenticity of the banknotes 15 based on this continuous data.

Moreover, because the directions of inclination of the plurality of detection coils 28 are all the same, even when the plurality of detection coils 28 are positioned in a line that extends in a direction that is orthogonal to the transporting direction of the banknotes 15, it is possible to arrange the detection coils 28 such that they are continuous when seen from the transporting direction of the banknotes 15 while also preventing interference between the detection coils 28.

Furthermore, because the plurality of detection coils 28 detects security threads 16 provided in banknotes 15, information in the security threads 16 can be detected without there being any increase in size in the transporting direction of the banknotes 15.

Figure 5:
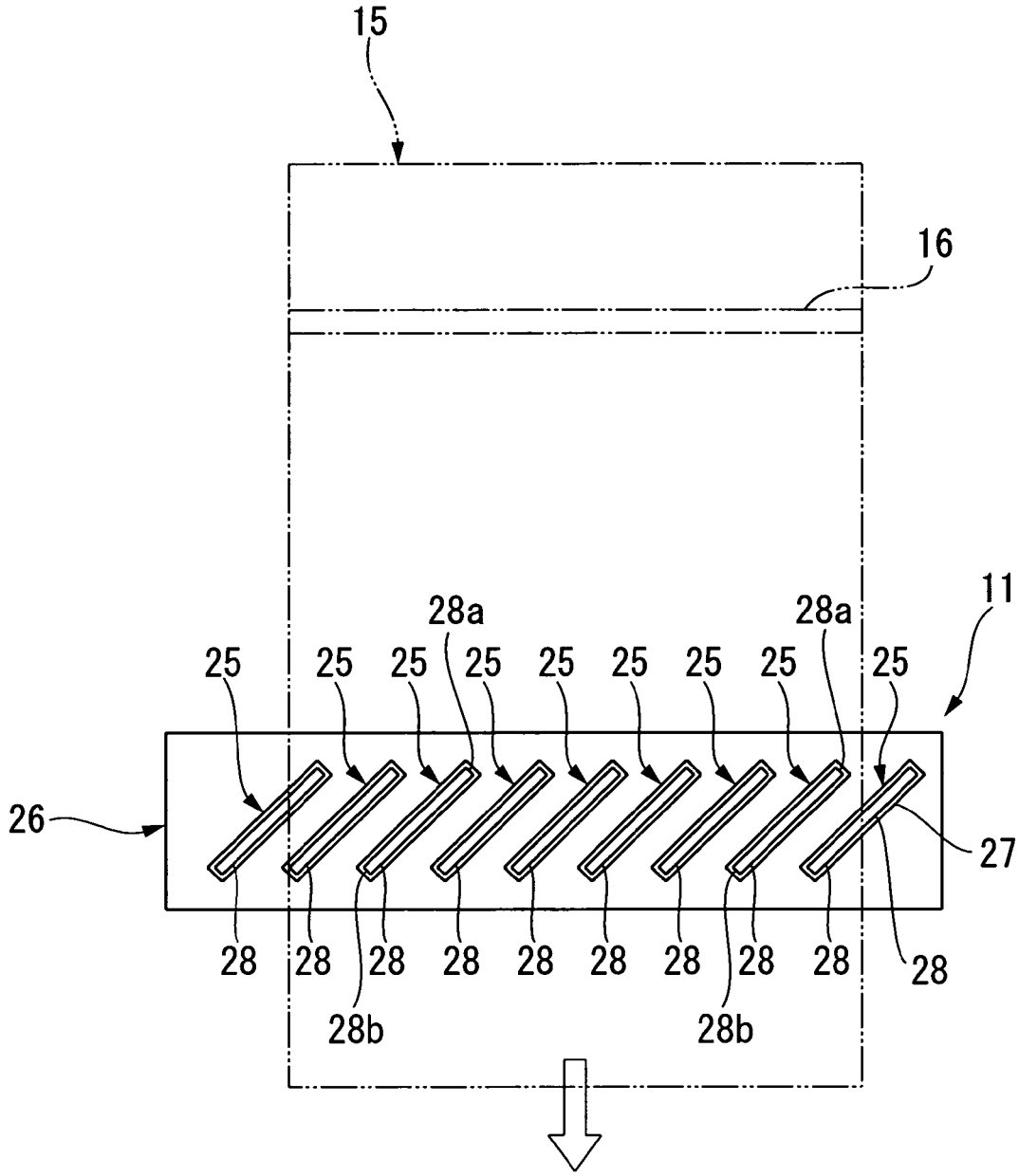
FIG. 5 is a plan view showing a banknote as well as a sensor array of the paper leaf detecting device of the second embodiment of the present invention.

Next, a description will be given of a paper leaf detecting device 11 according to the second embodiment of the present invention centering on points of variance thereof with the first embodiment with reference made mainly to FIG. 5. Note that the same descriptive symbols are applied to portions that are the same as in the first embodiment and a description thereof is omitted.

The paper leaf detecting device 11 of the second embodiment has a different sensor array 26 from that of the first embodiment.

In the sensor array 26 of the paper leaf detecting device 11 of the second embodiment, the same magnetic sensors 25 as in the first embodiment are formed by arranging a plurality (9 in the example shown) of the same detection coils 28 in a row as in the first embodiment. However, end portions that are adjacent to each other, as seen from the transporting direction of the banknotes 15, of all adjacent detection coils 28 are made to overlap each other by a predetermined amount. Namely, in this second embodiment as well, all of the detection coils 28 are positioned such that adjacent detection coils 28 are continuous when seen from the transporting direction of the banknotes 15.

In the second embodiment, because end portions that are adjacent to each other when seen from the transporting direction of the banknotes 15 of adjacent detection coils 28 overlap each other by a predetermined amount, a portion of the data that is detected in signals from adjacent detection coils 28 by these end portions that overlap each other when seen from the transporting direction of the banknotes 15 is the same data (the data portions of these adjacent detection coils 28 that overlap are referred to as overlapping data portions).

In this second embodiment as well, the signal synthesizing section 32 synthesizes signals from each memory section 31 that are connected to the respective detection coils 28 as a single continuous signal based on the transporting speed and the like at which the banknotes 15 are transported by the transporting section 31. At this time, the phases of the signals are matched using the overlapping data portions, and, thereafter, the signals are synthesized as a continuous signal using either one of the overlapping data portions. Note that it is also possible to synthesize the signals as a continuous signal using a portion of both of the overlapping data portions.

Specifically, the phases of the overlapping data portions are matched at the same time as the time differential and phases are shifted based on the speed at which the banknotes 15 are transported by the transporting section 13, the angle of inclination of each detection coil 28, the length of the detection section detected by each detection coil 28, and the order of the detection coils 28 from a signal from the detection coil 28 that is placed at an end portion in the extension direction of the security thread 16 on the side where the upstream portions 28*a* are located (i.e., the right side in FIG. 5) relative to the downstream portion 28*b* in a single detection coil 28, to a signal from the detection coil 28 that is placed at an end portion on the opposite side (i.e., the left side in FIG. 5) out of all the detection coils 28. After this, an overlapping data portion on a preset side of the overlapping data portions is removed, and the signals are sequentially connected together. As a result, a signal is obtained that is the same as a signal that is scanned continuously in the extension direction of the security thread 16. This signal has a pattern that corresponds to the encoded magnetic information held in the security thread 16.

In this manner, a signal that has been synthesized as a single continuous signal by the signal synthesizing section 32 is input into the identification section 33. In the identification section 33, based on this input signal, the authenticity and type of the banknote 15 is identified from the code that is read from the security thread 16 and the result thereof is output to a control section (not shown) on the banknote handling machine 12 side. At this time, the identification section 33 identifies the degree of matching between overlapping data portions for all of the overlapping data portions, and if at least one of the degrees of matching falls below a predetermined value, then it is determined that there is some sort of abnormality in the detected security thread 16 and that there is a possibility that the banknote 15 is counterfeit. An error signal is then output to the control section on the banknote handling machine 12 side.

According to the paper leaf detecting device 11 of the above described second embodiment, because end portions that are adjacent to each other when seen from the transporting direction of the banknotes 15 of adjacent detection coils 28 overlap each other by a predetermined amount, even though a plurality of detection coils 28 are used there are no unreadable portions between the detection coils 28 and, by matching phases using overlapping data portions, data can be reliably detected as continuous data. Specifically, the plurality of memory sections 31 respectively memorize the output signal from each detection coil 28, and the signal synthesizing section 32 synthesizes the signals from these memory sections 31 as a continuous signal using any one of the overlapping data portions. The identification section 33 then identifies the authenticity and type of the banknote 15 based on this synthesized signal. Accordingly, in the same way as in the first embodiment, it is possible to prepare continuous data that is obtained by scanning the security threads 16 in a direction that is orthogonal to the transporting direction of the banknotes 15, and identify the authenticity of the banknotes 15 based on this continuous data.

Moreover, because the directions of inclination of the plurality of detection coils 28 are all the same, in the same way as in the first embodiment, even when the plurality of detection coils 28 are positioned in a line that runs in a direction that is orthogonal to the transporting direction of the banknotes 15, it is possible to arrange the detection coils 28 such that end portions thereof that are adjacent when seen from the transporting direction of the banknotes 15 overlap each other by a predetermined amount, while interference between the detection coils 28 is also prevented.

In addition, because the identification section 33 identifies the degree to which overlapping data portions match, it is possible to identify the authenticity of the banknotes 15 in even more detail.

Note that, in the paper leaf detecting devices 11 of the above described first and second embodiments, a description is given of an example in which a plurality of detection coils 28 detect a security thread 16 that holds magnetic information, however, provided that there is a portion that holds magnetic information, then, it is of course possible to detect, for example, a print pattern of magnetic ink. In this case, the magnetic ink distribution information can be detected without there being any increase in size in the banknote transporting direction.

Figure 6:
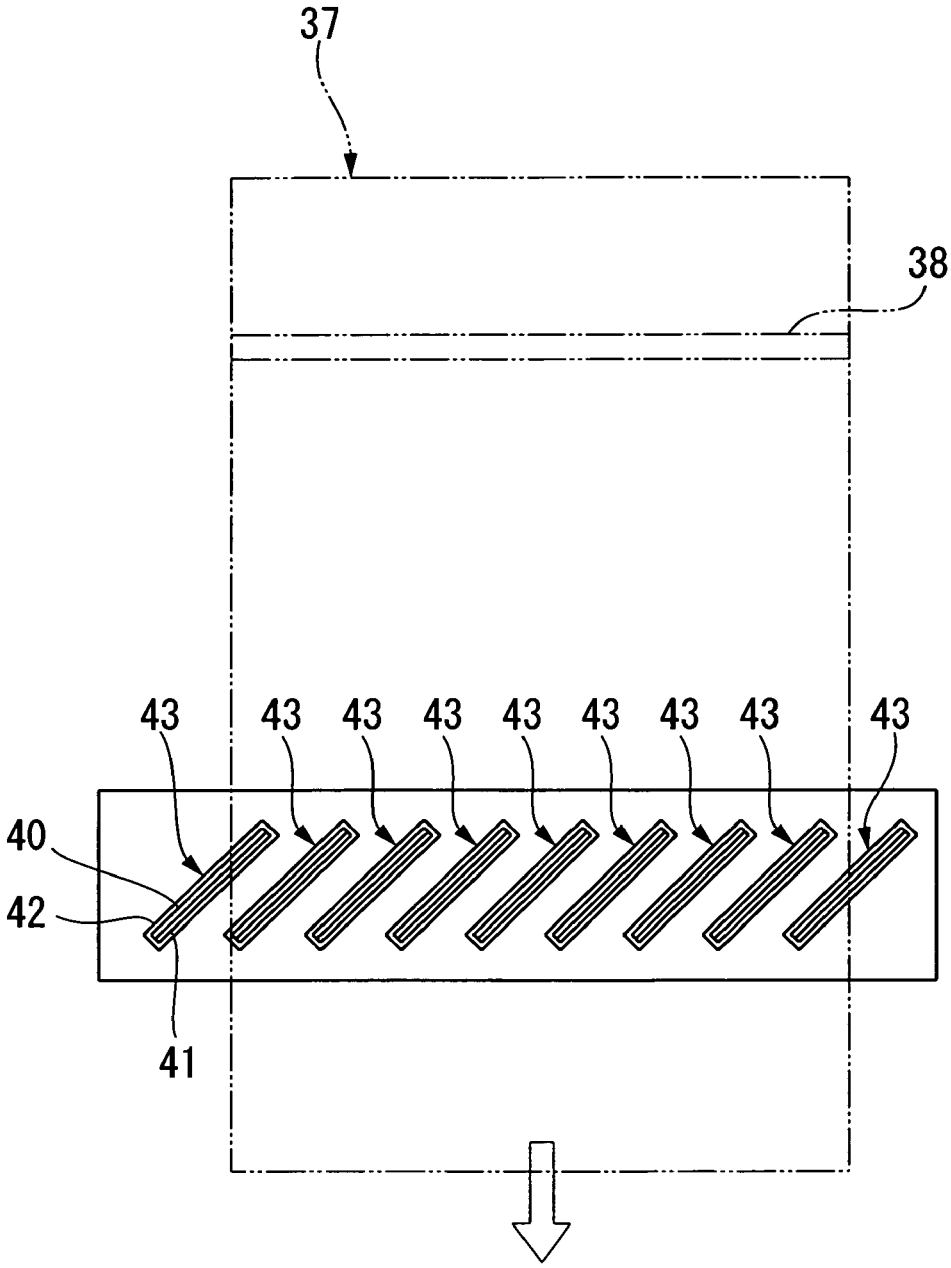
FIG. 6 is a plan view showing another example of the sensor array of the paper leaf detecting device of the present invention.

Furthermore, it is possible to alter the paper leaf detecting devices 11 of the first and second embodiments such that, as is shown in FIG. 6, they detect not a security thread 16 that holds magnetic information, but a security thread 38 that holds optical information in a banknote 37. In this case, optical sensors 43 are formed by providing on substrates 42 rectangular-shaped light sources 40 and optical receiving sections (i.e., sensors) 41 that are adjacent to each other with their positions matching in the longitudinal direction. These optical sensors 43 may be arranged such that the light sources 40 and optical receiving sections 41 are in the same state as the above described detection coils 28. For example, if paper leaves in which a fluorescent dye has been coated in a pattern on a plastic security thread are detected, then the emission of fluorescent light can be detected by the optical receiving sections 41 using an ultraviolet light source as the light source 40.

Moreover, in either paper leaf detecting device 11 of the first and second embodiments, when banknotes that are provided with a security thread extending in the transporting direction thereof are mixed in with other types of paper leaf, it is also possible to scan the security thread in the extension direction thereof.

Furthermore, in either paper leaf detecting device 11 of the first and second embodiments, a plurality of detection coils 28 may also be provided on a single substrate so as to have the above described attitude.

In addition, the present invention is not limited to the detection of banknotes and may be applied to the detection of a variety of other types of paper leaf.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A paper leaf detecting device comprising:

a plurality of sensors positioned at an oblique angle relative to a transporting direction of leaves of paper, the plurality of sensors being arranged in a single row that extends in a direction orthogonal to the transporting direction of the leaves of paper, wherein directions of inclination of the plurality of sensors are all identical, and wherein adjacent sensors are continuous with each other when seen from the transporting direction of the leaves of paper;

a plurality of memory devices that respectively memorize output signals from each of the sensors;

a synthesizing device that synthesizes signals from the memory devices as a continuous signal; and an identification device that identifies whether or not leaves of paper are authentic based on the signal synthesized by the synthesizing device.

2. The paper leaf detecting device according to claim 1, wherein the plurality of sensors detect a security thread provided in a leaf of paper.

3. The paper leaf detecting device according to claim 1, wherein the plurality of sensors detect magnetic ink provided in a leaf of paper.

4. A banknote handling machine comprising a paper leaf detecting device according to claim 1.

5. A paper leaf detecting device comprising a plurality of sensors positioned at an oblique angle relative to a transporting direction of leaves of paper, the plurality of sensors being arranged in a single row that extends in a direction orthogonal to the transporting direction of the leaves of paper, wherein:

directions of inclination of the plurality of sensors are all identical, and adjacent sensors are continuous with each other when seen from the transporting direction of the leaves of paper; and adjacent sensors have end portions that are adjacent to each other when seen from the transporting direction of the leaves of paper overlapping each other.

6. The paper leaf detecting device according to claim 5, further comprising a plurality of memory devices that respectively memorize output signals from each of the sensors, a synthesizing device that synthesizes signals from the memory devices as a continuous signal using one or a portion of both of overlapping data portions from adjacent sensors, and an identification device that identifies whether or not leaves of paper are authentic based on the signal synthesized by the synthesizing device.

7. The paper leaf detecting device according to claim 6, wherein the identification device further identifies a degree to which overlapping data portions match each other.

8. The paper leaf detecting device according to claim 6, wherein the plurality of sensors detect a security thread provided in a leaf of paper.

9. The paper leaf detecting device according to claim 6, wherein the plurality of sensors detect magnetic ink provided in a leaf of paper.

10. A banknote handling machine comprising a paper leaf detecting device according to claim 6.

11. The paper leaf detecting device according to claim 5, wherein the plurality of sensors detect a security thread provided in a leaf of paper.

12. The paper leaf detecting device according to claim 5, wherein the plurality of sensors detect magnetic ink provided in a leaf of paper.

13. A banknote handling machine comprising a paper leaf detecting device according to claim 5.

* * * * *